US009560924B2

(12) United States Patent
Lawson

(10) Patent No.: US 9,560,924 B2
(45) Date of Patent: Feb. 7, 2017

(54) CONNECTION ASSEMBLY

(71) Applicant: Richard John Lawson, Derbyshire (GB)

(72) Inventor: Richard John Lawson, Derbyshire (GB)

( * ) Notice: Subject to any disclaimer, the term of this patent is extended or adjusted under 35 U.S.C. 154(b) by 0 days.

(21) Appl. No.: 14/772,664

(22) PCT Filed: Feb. 14, 2014

(86) PCT No.: PCT/GB2014/050428

§ 371 (c)(1),
(2) Date: Sep. 3, 2015

(87) PCT Pub. No.: WO2014/135842

PCT Pub. Date: Sep. 12, 2014

(65) Prior Publication Data

US 2016/0015191 A1 Jan. 21, 2016

(30) Foreign Application Priority Data

Mar. 4, 2013 (GB) ..... 1303811.2

(51) Int. Cl.

| | |
|---|---|
| ***G09F 1/12*** | (2006.01) |
| ***A47G 1/10*** | (2006.01) |
| ***A47G 1/06*** | (2006.01) |
| ***E06B 3/98*** | (2006.01) |

(52) U.S. Cl.
CPC ..... *A47G 1/10* (2013.01); *A47G 1/0605* (2013.01); *E06B 3/982* (2013.01)

(58) Field of Classification Search
CPC ..... A47G 1/10; A47G 1/0605; E06B 3/982
USPC ..... 40/782
See application file for complete search history.

(56) References Cited

U.S. PATENT DOCUMENTS

| | | | | |
|---|---|---|---|---|
| 4,516,341 A * | 5/1985 | Jenkins | A47G 1/10 40/785 |
| 4,610,565 A * | 9/1986 | Nakayama | A47G 1/10 40/782 |
| 4,714,373 A | 12/1987 | Heekin | |
| 4,820,077 A | 4/1989 | Sawada | |
| 4,825,529 A | 5/1989 | Sawada | |
| 5,799,430 A * | 9/1998 | Fremstad | A47G 1/10 40/782 |

(Continued)

FOREIGN PATENT DOCUMENTS

JP 2007117406 A 5/2007

OTHER PUBLICATIONS

PCT/GB2014/050428—International Search Report and Written Opinion, mailed Apr. 22, 2014, 11 pages.

*Primary Examiner* — Shin Kim
(74) *Attorney, Agent, or Firm* — Han Santos Reich, PLLC

(57) ABSTRACT

A connection assembly 10 usable for interconnecting two elongate frame members 12 which each include a channel 14. An elongate link member 22 is locatable in the channels 14 of the adjacent members 12 and extending therebetween. A respective connection assembly 20 is locatable in each of the channels 14 to engage against the link member 22 and retain same in the respective channel 14. Each connection assembly 20 is selectively movable between an engaged and a disengaged condition to respectively connect the two frame members 12, or permit the frame members 12 to be pulled apart.

20 Claims, 7 Drawing Sheets

(56) References Cited

U.S. PATENT DOCUMENTS

| | | | | |
|---|---|---|---|---|
| 5,820,292 | A * | 10/1998 | Fremstad | A47G 1/10<br>403/205 |
| 6,339,891 | B1 | 1/2002 | Cox | |
| 6,405,467 | B1 * | 6/2002 | Dedlow | G09F 7/04<br>40/107 |

* cited by examiner

FIG. 13
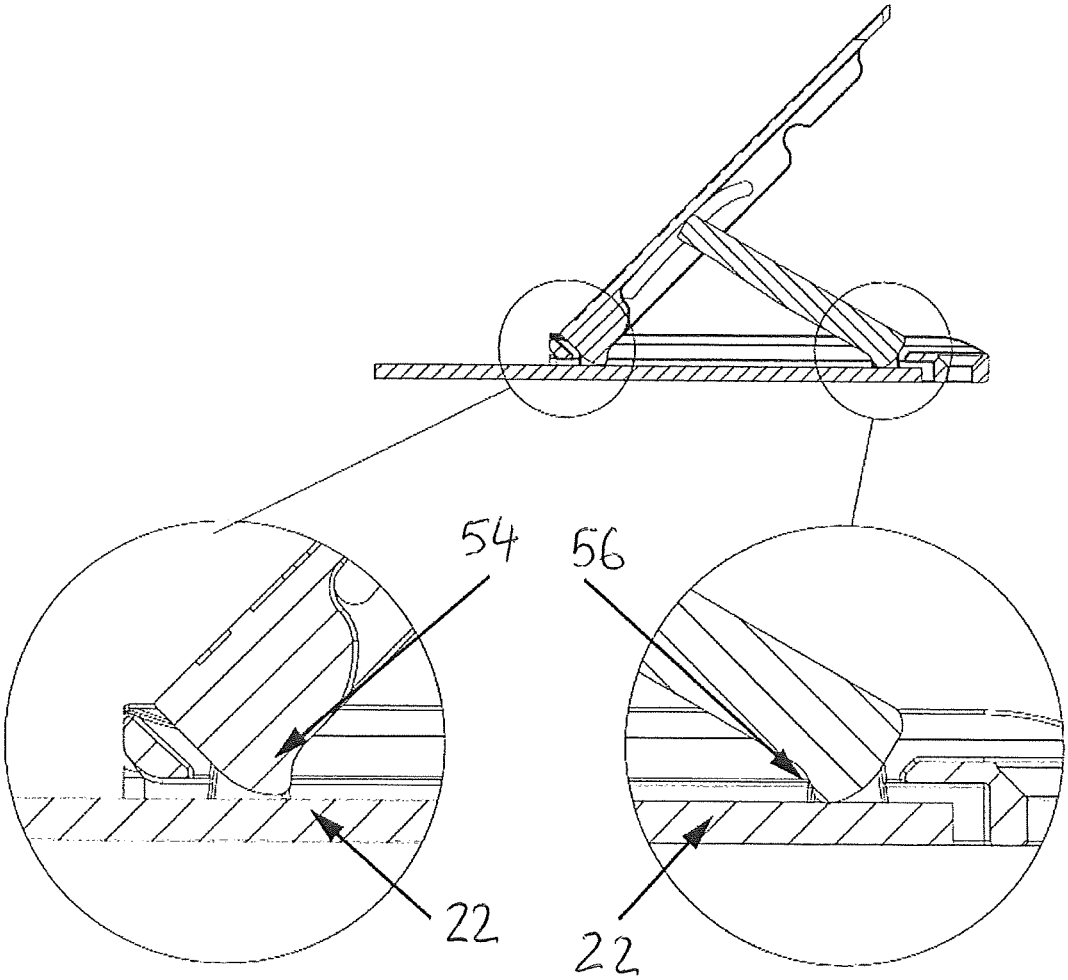
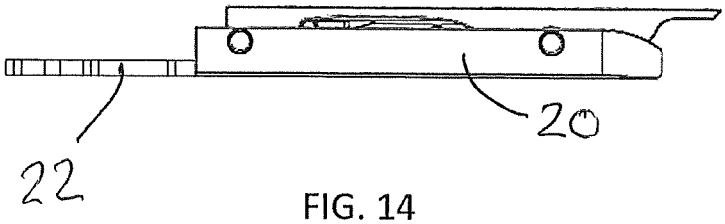
FIG. 14

CONNECTION ASSEMBLY

This invention concerns connection assemblies, and particularly but not exclusively connection assemblies usable for connecting components of a frame of a display apparatus, and also frame assemblies incorporating such connection assemblies.

With display apparatus it is often required for the apparatus to be regularly erected and dismantled for use for instance at different exhibitions or other locations. Existing and previous frame constructions for display apparatus often requires the use of tools and fastening means such as screws to carry out erection and dismantling. Such tools may not always be to hand, and also the fastening means can be lost. It can also be quite time consuming to mount all the fastening means required.

Also such constructions have often not been sufficiently robust to survive regular erection and dismantling, and particularly by persons who may not use correct procedures for such operations. It is often required to join together two lengths of frame material in a display apparatus, and it may be required for the lengths to be at a required relative inclination to each other, from colinear to perpendicular.

Such lengths of frame material are often produced by for example extruding aluminium. The profiles of such extrusions are not always uniform, and it can therefore be difficult to rigidly mount together adjacent lengths of such frame material.

According to the present invention there is provided a connection assembly for joining together two elongate frame members which frame members each include a channel, which channels are alignable together when the frame members are connected, the assembly including an elongate link member with a first part locatable in the channel of a one of the frame members, and second part locatable in the channel of the other of the frame members, a pair of engagement assemblies each locatable in the channel of a respective frame member, the engagement assemblies being selectively movable between an engaged condition where a spaced pair of engagement members are engageable with the link member to urge same against the floor of the channel in a respective frame member, and a disengaged condition where the engagement members do not urge the link member against the channel, and the link member is slidably movable along the channel.

The engagement assemblies may each include a body which is slidably movable along the channel of a frame member, but which is of a size to be restrained within the channel and only slidably movable therealong.

The engagement assemblies may each include a handle movably mounted to the body to move the assembly between the engaged and disengaged conditions. The handle may be pivotally mounted to the body.

The engagement assemblies may be arranged such that in the engaged condition the handle locates substantially within the channel of a respective frame member.

The engagement members may comprise a pair of cam members rotatably movable between engaged and disengaged positions. The cam members may each be rotatably movable between engaged and disengaged positions in opposite directions to each other.

A one of the cam members may be provided on the handle, and may be provided adjacent a pivotal mounting of the handle to the body.

The engagement assemblies may each include a connecting member extending between the handle and the body, spaced from the pivotal mounting of the handle to the body.

The connecting member may at one end be pivotally mounted to the body, and the other cam member may be provided on the connecting member adjacent the pivotal mounting thereof to the body.

The other end of the connecting member may be movably mounted to a slot or slots in the handle.

The handle may be a snap fit on the body, and the connecting member may be a snap fit on the body.

The engagement assemblies may be made of metal and may be made for instance of zinc, and may be made by die casting.

In one embodiment the first and second parts of the link member are colinear.

In other embodiments the first and second parts of the link member are inclined relative to each other, and in a further embodiment may be perpendicular to each other.

The link member may be in the form of a length of plate, which plate may be of metal and for instance sprung steel.

The invention also provides a frame assembly, the assembly comprising two elongate frame members with one or more longitudinal channels on the exterior of the elongate members, and a connection assembly according to any of the preceding fourteen paragraphs provided on ends of the frame members and extending therebetween.

The channels of the frame members may have flanges extending along their openings such that the openings of the channels are narrower than the remainder of the channels.

The elongate members may be extrusions, and may be aluminium extrusions.

An embodiment of the present invention will now be described by way of example only and with reference to the accompanying drawings in which:

FIG. 13 is a cross sectional side view of the first and second parts of the assembly in a disengaged condition, with two areas of detail shown.

FIG. 14 is a side view of the first and second parts of the assembly in an engaged condition.

Figure 1:
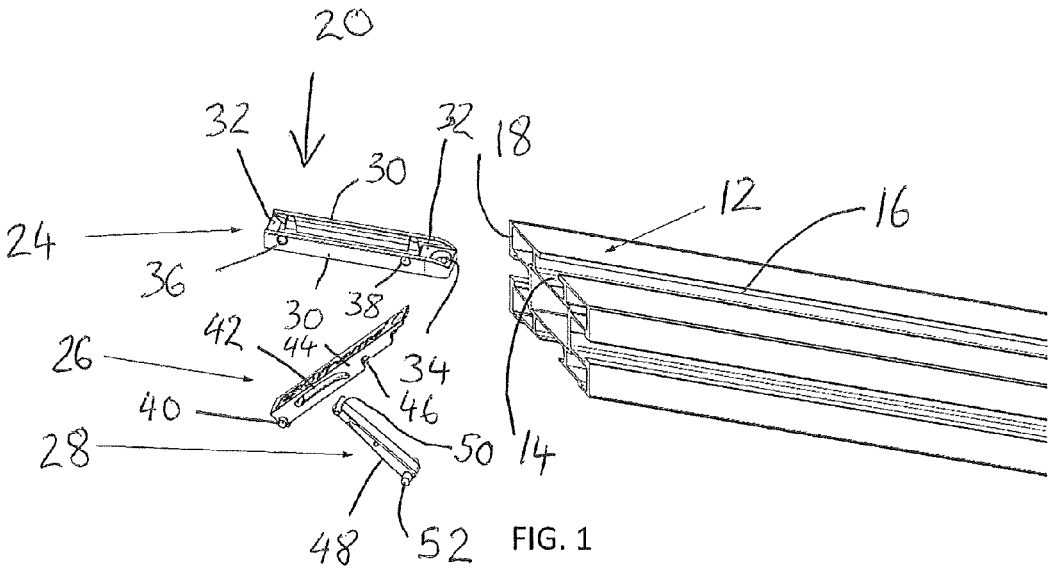
FIGS. 1 to 9 are respectively sequential diagrammatic perspective views showing a connection assembly according to the invention being formed.
Figure 2:
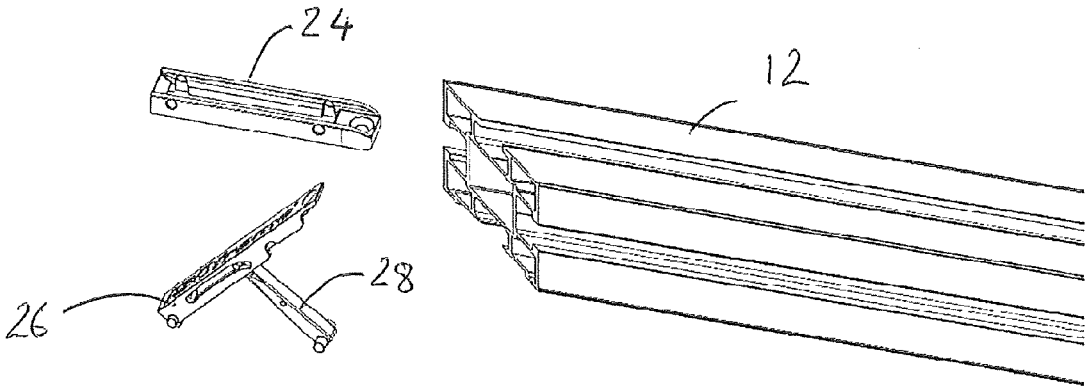
Figure 3:
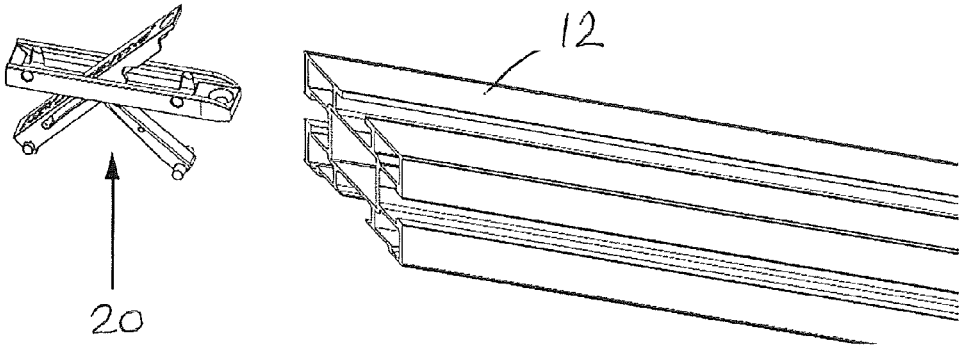
Figure 4:
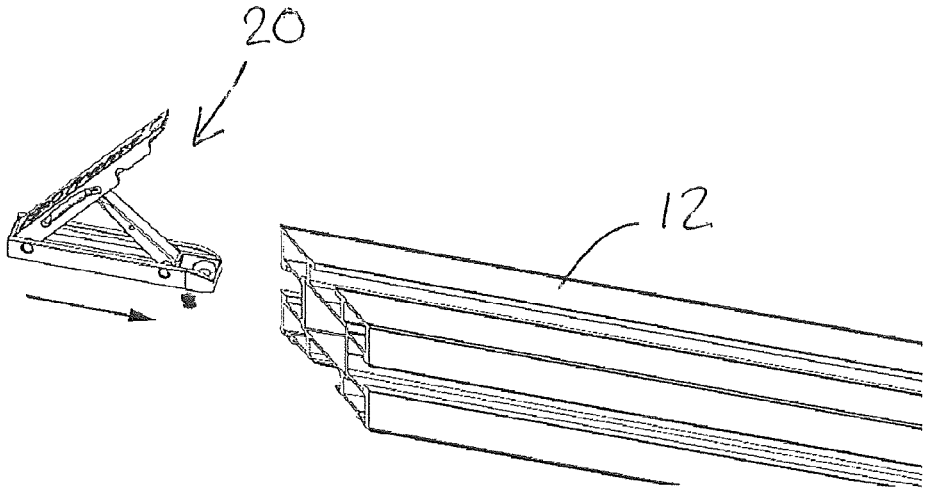
Figure 5:
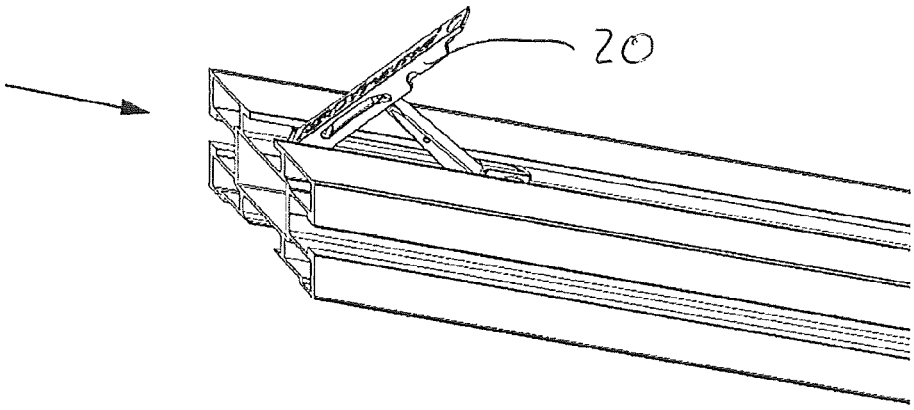

The drawings show a connection assembly 10 usable for interconnecting two extruded square section aluminium elongate frame members 12. Such frame members 12 may for instance be part of a display apparatus. In the drawings the frame members 12 are being shown mounted together perpendicularly to each other.

Each of the frame members 12 has a channel 14 on each face with flanges 16 on either side of the channel such that the channel 14 has a reduced size opening relative to the remainder of the channel 14. Each of the frame members 12 has an end face 18 cut at 45° to provide a mitre connection.

The assembly 10 also includes a pair of connection assemblies 20 each slidably located in the channel 14 adjacent a respective end face 18. The assembly 10 also includes an elongate link member 22 in the form of an L shaped sprung steel plate. The link member 22 is also locatable in the respective channels 14 in the frame members 12 beneath the connection assemblies 20, so as to interconnect two frame members 12.

Each connection assembly 20 includes a body 24, a handle 26 and a connecting member 28. The body 24 comprises a pair of spaced side members 30 interconnected by webs 32 at each end. A fixing hole 34 is provided through the right hand web 32 as shown for instance in FIG. 1, to permit fixing in position on a frame member 12 if required.

A pair of aligned mounting holes 36, 38 are provided through the side members 30 with a first pair of mounting holes 36 adjacent the left hand end of the body 24 as shown for instance of FIG. 1, a second pair of mounting holes 38 towards but further spaced from the right hand end as shown for instance in FIG. 1 of the side members 30.

The body 24 should be of a size that it will probably be retained in position in the respective channel 14 by friction, and may require tapping to locate into the channel 14. This will depend to some extent on the precise dimensions of the channel 14 which can be variable to some degree. The body 24 is of a width that cannot be moved past the flanges 16.

The handle 26 has a generally n shaped profile with a pair of mounting lugs 40 at the left hand end as shown in FIG. 1 which are a snap fit in the first mounting holes 36 to provide a pivotal mounting between the handle 26 and the body 24. A pair of arcuate aligned slots 42 are provided in side walls 44 of the handle 26. A cut out 46 is provided in each side wall 44 spaced a short way to the right hand end of the slots 42. The side walls 44 stop a short distance before the right hand end as shown in FIG. 1 of the handle 26, to facilitate engagement thereof for instance by a person's finger.

The connecting member 28 is in the form of a bar 48 of a size to slidingly extend between the side members 30 of the body 24. A pair of mounting lugs 50 are provided extending outwardly on each side of the bar 48 at the left hand end as shown in FIG. 1. The mounting lugs 50 can be snap fitted to engage in the slots 42 in the handle 26. A larger pair of mounting lugs 52 are provided at the right hand end of the bar 48 as shown in FIG. 1, and can be snap fitted into the second pair of mounting holes 38 in the body 24.

First and second cam members 54, 56 are provided respectively on the underside of the handle 26 at the left hand end thereof as shown in FIG. 1, and the underside of the connecting member 28 at the right hand end of the connecting member 28 as shown in FIG. 1. The first and second cam members 54, 56 are shown in more detail in FIGS. 13 and 15.

Figure 9:
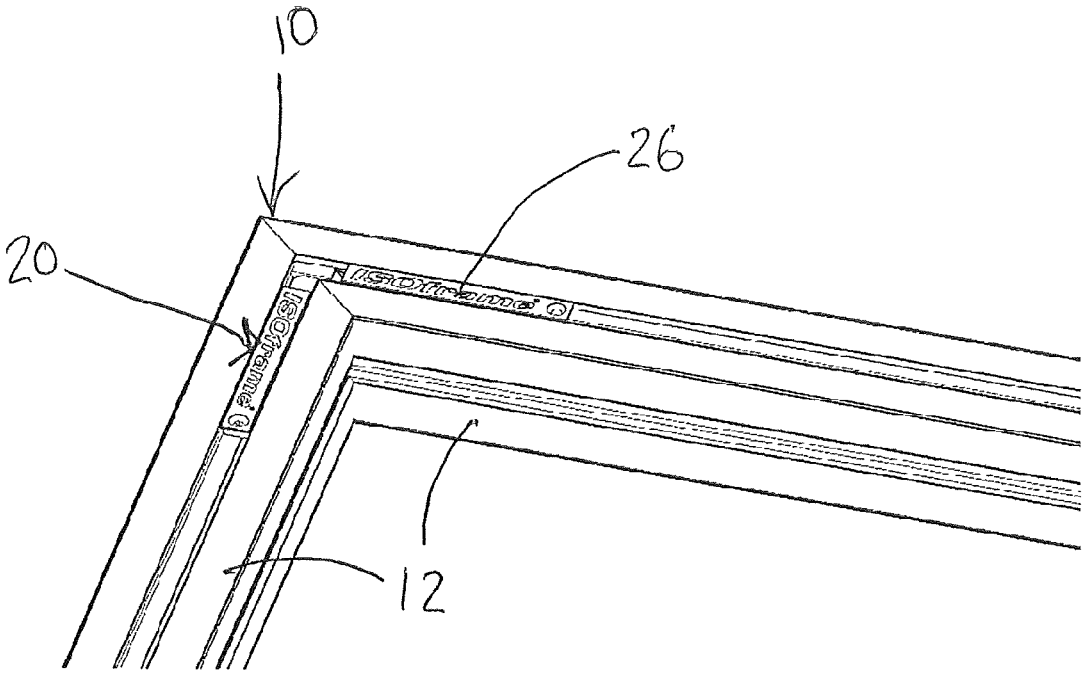
Figure 10:
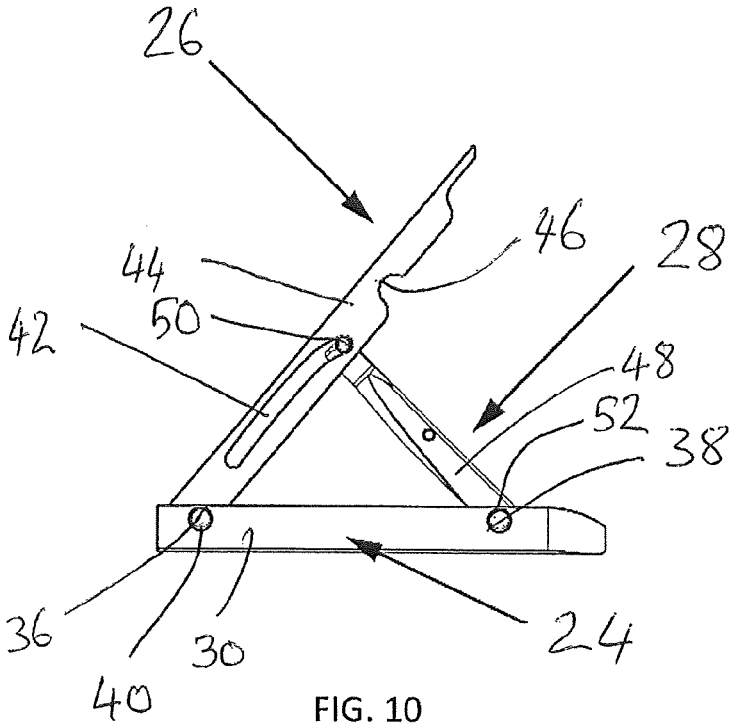
FIG. 10 is a side view of a first part of the assembly of FIG. 1 in a disengaged condition.
Figure 11:
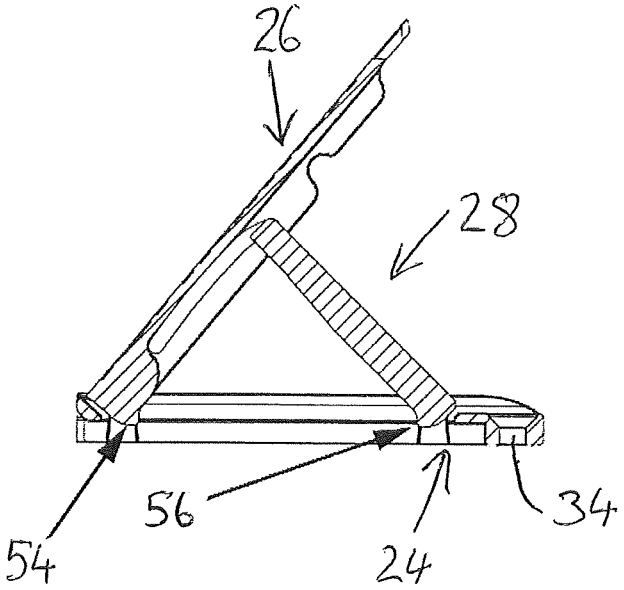
FIG. 11 is a cross sectional side view of the first part shown in FIG. 10 in a disengaged condition.
Figure 12:
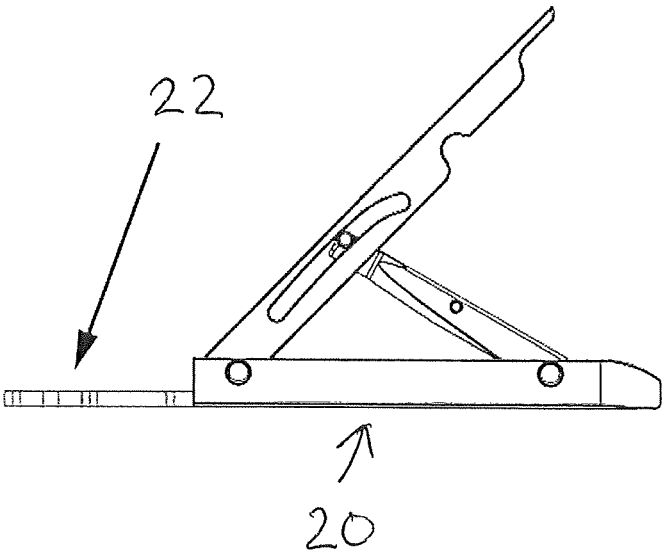
FIG. 12 is a side view of first and second parts of the assembly of FIG. 1 in a disengaged condition.
Figure 15:
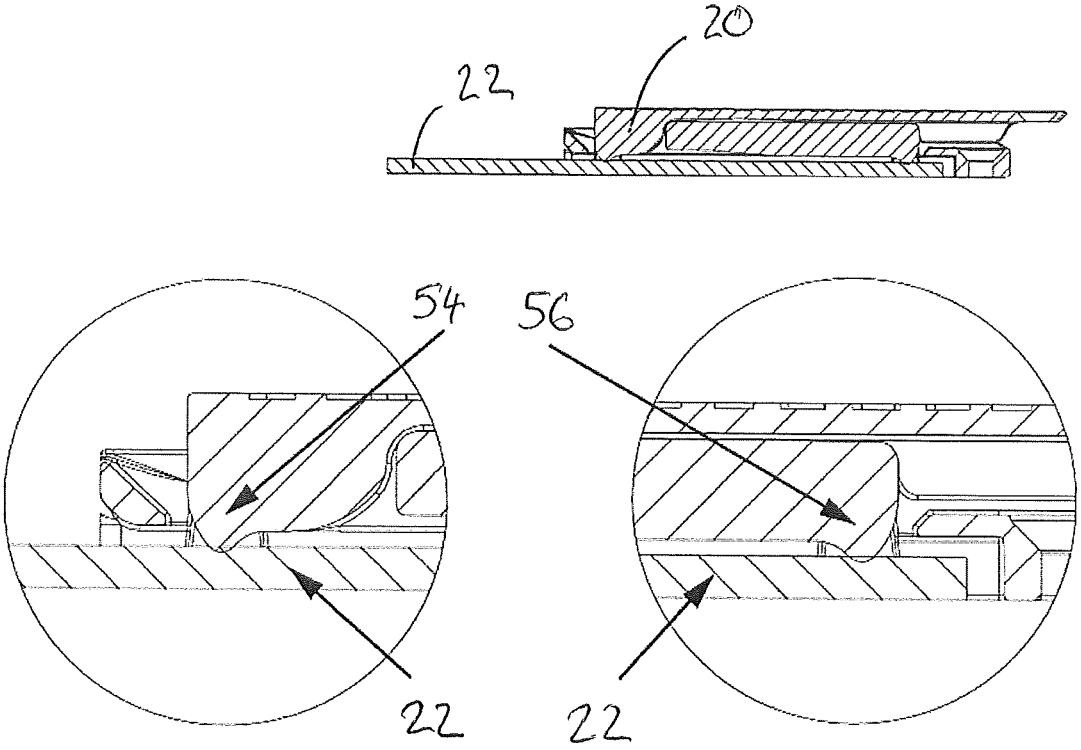
FIG. 15 is a cross sectional side view of the first and second parts of the assembly in an engaged condition, with two areas of detail shown.

The connecting assemblies 10 are typically made from zinc by die casting and can be snap fitted together as shown in FIGS. 1 to 4. The connection assemblies 10 are movable between a disengaged condition as shown for instance in FIGS. 5 to 8 and 10 to 13, and an engaged condition as shown in FIGS. 9, 14 and 15. In the engaged condition the handle 16 is pivoted upwardly away from the body 14 as far as is permitted by the connecting member 28.

The first smaller mounting lugs 50 of the connecting member 28 locate in the right hand ends of the slots 42. In this alignment the first and second cam members 54, 56 are in a relatively raised position.

To move a connection assembly 20 to an engaged condition, the handle 26 is moved downwardly. This causes clockwise rotation of the left hand end of the handle 26 moving the first cam member 54 into an engagement position extending further downwardly. As the handle 26 moves downwardly the connecting member 28 will rotate in an anti-clockwise direction and thus the second cam member 56 will rotate and extend further downwardly into an engaged position as shown for instance in FIG. 15.

Figure 6:
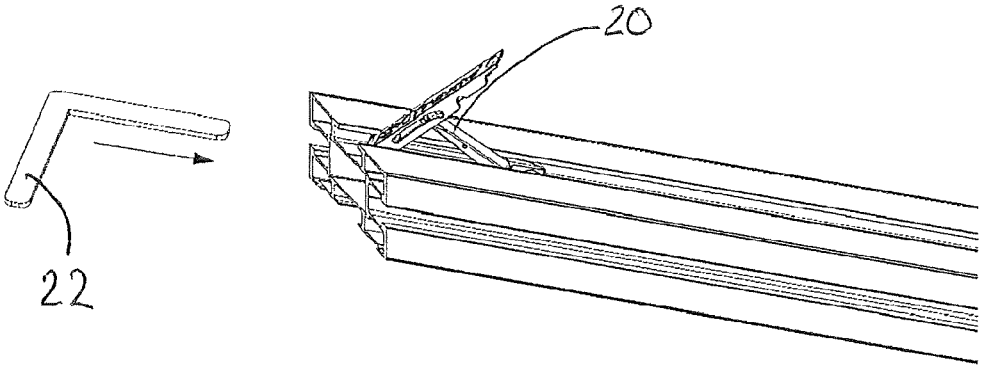
Figure 7:
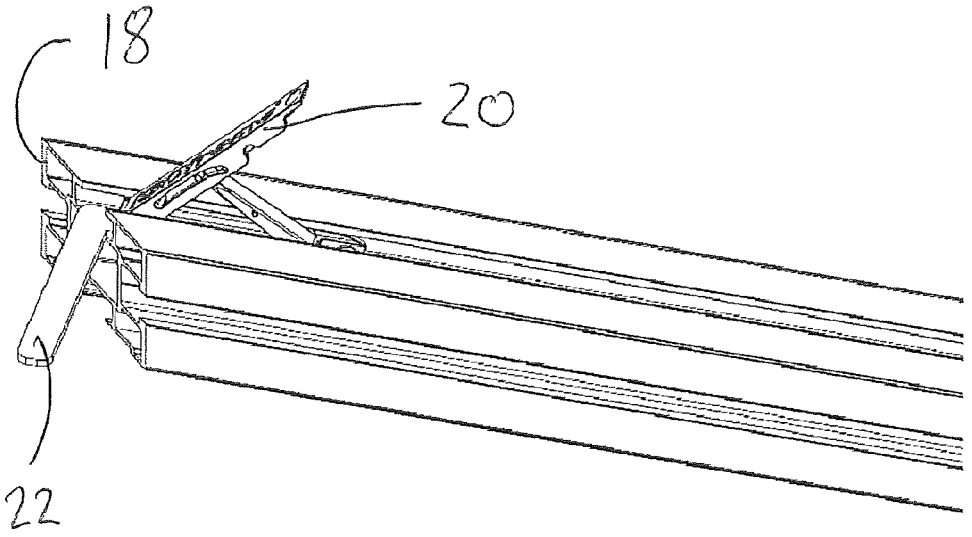
Figure 8:
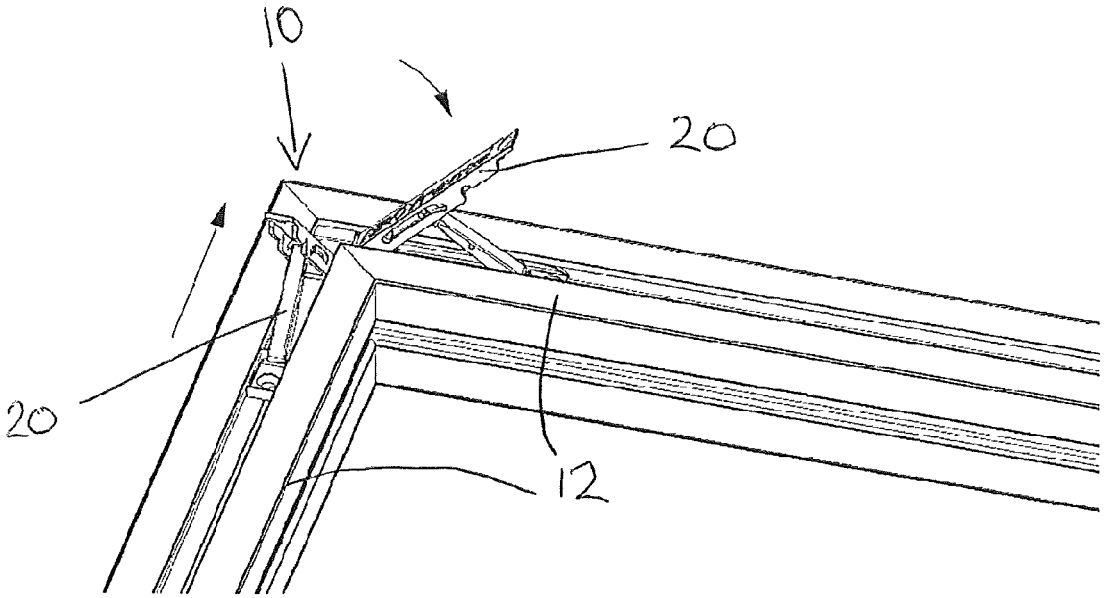

In the drawings FIGS. 1 to 4 show the fitting together of an engagement assembly 20 and location thereof in a channel 14. FIG. 6 shows the link member 22 being brought into position and slid under the engagement assembly 20 as shown in FIG. 7.

The other frame member 12 is brought into position incorporating another engagement assembly 20, with both engagement assemblies 20 in a disengaged condition, and with the link member 22 extending between the frame members 12 and underneath the engagement assemblies 20. The engagement assemblies 20 are then moved into an engaged condition by moving the handles 26 downwardly and causing engagement of the first and second cam members 54, 56 with the link member 22, as outlined above, which rigidly clamps the assembly 10 together. Once fully engaged the handles 26 also locate within the channels 24 thereby being aesthetically pleasing and not interfering with operation of the frame members 12 in any way.

The assembly 10 provides engagement at two spaced positions with the link member on each frame member, which substantially prevents rotation thereof about the connection. The first and second cam members are brought into engagement with the link member in opposite directions to substantially prevent any unwanted sliding movement of the link member occurring during engagement or disengagement thereof.

The cam members just engage with the link member, whilst the link member provides the connection along the length thereof. This arrangement provides for a very strong connection.

The assembly 10 permits assembly and operation without the use of any tools, and extra fastening means etc. The connection assemblies can be assembled without tools. They can also be inserted into the respective frame members generally without tools, as can the link members.

This means that the connection assembly can be readily and quickly assembled, and also permits ready disconnection of the frame members. Not requiring tools nor extra fastening means means that there should never be a situation where the required tools or fastening means are not present which otherwise can result in the assembly being incorrectly assembled or disassembled, potentially causing damage thereto and/or an insufficiently rigid assembly.

The connection assembly and particularly the engagement assemblies are of relatively straightforward construction, and thus can be manufactured for long term and maintenance free use.

The invention therefore provides for a strong connection between two frame members, which can be readily engaged or disengaged by an unskilled operative, and without requirement for any use of tools or fastening means.

It is to be realised that a wide range of modifications may be made without departing from the scope of the invention. For instance the engagement assemblies could take a different form, and could be made of different materials.

It is to be realised that frame members can be joined together at any relative orientation, and this is determined by the shape of the connecting member, and also the inclination of the end faces of the frame members. Whilst the invention has been described in terms of frame members used in a display apparatus, such a connection assembly could be used elsewhere.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A connection assembly for joining together two elongate frame members which frame members each include a channel, which channels are alignable together when the frame members are connected, the connection assembly including:

an elongate link member with a first part locatable in the channel of a first one of the frame members, and second part locatable in the channel of a second one of the frame members; and a pair of engagement assemblies each locatable in the channel of a respective frame member, the engagement assemblies being selectively movable between an engaged condition where a spaced pair of engagement members are engageable with the link member to urge same against a floor of the channel in a respective frame member, and a disengaged condition where the engagement members do not urge the link member against the channel, and the link member is slidably movable along the channel, each of the pair of engagement assemblies including a body and a connecting member extending between a handle and the body, the handle being pivotally mounted to the body, and each connecting member being spaced from a pivotal mounting of the handle to the body.

2. The connection assembly according to claim 1, wherein the body of each engagement assembly is slidably movable along the channel of a frame member, but which is of a size to be restrained within the channel and only slidably movable therealong.

3. The connection assembly according to claim 2, wherein each handle is movably mounted to a corresponding body of an engagement assembly to move the engagement assembly between the engaged and disengaged conditions, and wherein the connecting member is a snap fit on the body.

4. The connection assembly according to claim 3, wherein the engagement assemblies are arranged such that in the engaged condition the handle locates substantially within the channel of a respective frame member.

5. The connection assembly according to claim 1, wherein the engagement members comprise a pair of cam members rotatably movable between engaged and disengaged positions.

6. The connection assembly according to claim 5, wherein the cam members are each rotatably movable between engaged and disengaged positions in opposite directions to each other.

7. The connection assembly according to claim 5, wherein a first one of the cam members is provided on the handle, and wherein a second one of the cam members is provided adjacent a pivotal mounting on the handle to the body.

8. An assembly according to claim 1, wherein the connecting member is at one end pivotally mounted to the body.

9. An assembly according to claim 5, wherein a first one of the cam members is provided on the handle, and wherein a second one of cam members is provided on the connecting member adjacent the pivotal mounting thereof to the body.

10. The connection assembly according to claim 8, wherein an end of the connecting member is movably mounted to a slot or slots in the handle.

11. The connection assembly according to claim 3, wherein the handle is a snap fit on the body.

12. The connection assembly according to claim 1, wherein the engagement assemblies are made of metal that includes zinc, and wherein the engagement assemblies are made via die casting.

13. The connection assembly according to claim 1, wherein the first and second parts of the link member are colinear.

14. The connection assembly according to claim 1, wherein the first and second parts of the link member are inclined relative to each other.

15. The connection assembly according to claim 14, wherein the first and second parts of the link member are perpendicular to each other.

16. The connection assembly according to claim 1, wherein the link member is in a form of a length of plate.

17. The connection assembly according to claim 16, wherein the plate is of metal, and wherein the plate is of sprung steel.

18. A frame assembly, the frame assembly comprising:

a plurality of elongate frame members with one or more longitudinal channels on an exterior of the elongate frame members;

an elongate link member with a first part locatable in the channel of a first one of the plurality of elongate frame members, and second part locatable in the channel of a second one of the plurality elongate frame members; and a pair of engagement assemblies each locatable in the channel of a respective elongate frame member, the engagement assemblies being selectively movable between an engaged condition where a spaced pair of engagement members are engageable with the link member to urge same against a floor of the channel in a respective elongate frame member, and a disengaged condition where the engagement members do not urge the link member against the channel, and the link member is slidably movable along the channel, each of the engagement assemblies including a body and a connecting member extending between a handle and the body, the handle being pivotally mounted to the body, and each connecting member being spaced from a pivotal mounting of the handle to the body.

19. The frame assembly according to claim 18, wherein the channels of the plurality of elongate frame members have flanges extending along their openings such that the openings of the channels are narrower than a remainder of the channels.

20. The frame assembly according to claim 18, wherein the elongate frame members are aluminum extrusions.

* * * * *